United States Patent [19]

Ebihara

[11] Patent Number: 4,706,865

[45] Date of Patent: Nov. 17, 1987

[54] STAPLER

[75] Inventor: Yoshiyuki Ebihara, Tokyo, Japan

[73] Assignee: Etona Company, Limited, Japan

[21] Appl. No.: 896,201

[22] Filed: Aug. 14, 1986

[30] Foreign Application Priority Data

Nov. 14, 1985 [JP] Japan ..... 60-255604

[51] Int. Cl.[4] ..... B25C 5/11

[52] U.S. Cl. ..... 227/110; 227/156; 227/120

[58] Field of Search ..... 227/120, 155, 156, 146, 227/132, 123, 110

[56] References Cited

U.S. PATENT DOCUMENTS

| | | | |
|---|---|---|---|
| 1,067,541 | 7/1913 | Palmgren | 227/132 |
| 1,655,275 | 1/1928 | Place | 227/132 |
| 1,688,879 | 10/1928 | Polzer | 227/132 |
| 1,709,756 | 4/1929 | Szepe | 227/132 |
| 3,640,443 | 2/1972 | Hagaki | 227/120 |
| 4,432,484 | 2/1984 | Maestri | 227/132 |
| 4,556,161 | 12/1985 | Oide | 227/109 |
| 4,607,777 | 8/1986 | Ebihara | 227/120 |

*Primary Examiner*—Paul A. Bell
*Assistant Examiner*—James L. Wolfe
*Attorney, Agent, or Firm*—Andrus, Sceales, Starke & Sawall

[57] ABSTRACT

The present invention provides a stapler comprising a base formed with an anvil at its forward end, a frame containing a set of staples and forwardly biasing the set of staples to position the forwardmost one of the staples at a location coincident with a staple driving aperture formed in the frame at its forward end, and a handle pivotally mounted on the frame on the opposite side to the base, the handle including an actuating member formed thereon at its forward end and which extends downwardly from the handle, the actuating member adapted to move through the staple driving aperture in the frame and to drive the forwardmost staple from the frame toward the anvil on the base when the handle is pivoted toward the frame, at least the handle being injection molded integrally with the actuating member from a plastic material, the actuating member including a body having a plate-shaped cross-section and thick-walled reinforcing portion extending along the length of the body of the actuating member.

1 Claim, 5 Drawing Figures

STAPLER

BACKGROUND OF THE INVENTION

Field of the Invention

The present invention relates to an improvement of a stapler for driving an inverted U-shaped staple through articles such as sheets of paper to bind them together.

Description of the Prior Art

There is known a stapler comprising a base portion with an anvil on its forward end, a frame portion containing a set of staples and urging them toward the forward end to position the forwardmost one of the staples at a location coincident with a driving aperture on the frame portion, and a handle portion pivotally mounted on the frame portion at the opposite side to the base portion, the handle portion including an actuating member on its forward end for moving through the driving aperture of the frame portion and driving the forwardmost one of the staples from the frame portion toward the anvil on the base portion. It is also known that all the base, frame and handle portions are of a plastic material. For strength and durability, however, the anvil and actuating member are normally made of steel since they directly engage the staples of steel when driven and deformed. Therefore, the prior art requires a troublesome operation that separate parts of steel are mounted on the base and handle portions, respectively.

SUMMARY OF THE INVENTION

It is therefore an object of the present invention to provide an improved stapler which is advantageous over the prior art with respect to manufacturing and material costs.

To this end, the present invention provides a stapler of the aforementioned type in which at least the handle portion is injection molded integrally with an actuating member from a plastic material, the actuating member having a thick-walled reinforcing portion formed thereon and which extends along the length of the actuating member.

Since the actuating member is formed integrally on the handle portion, no operation of mounting the actuating member on the handle portion is required. In addition, the use of steel is advantageously reduced since the actuating member is of the same plastic material as that of the handle portion.

DESCRIPTION OF PREFERRED EMBODIMENTS

Figure 2:
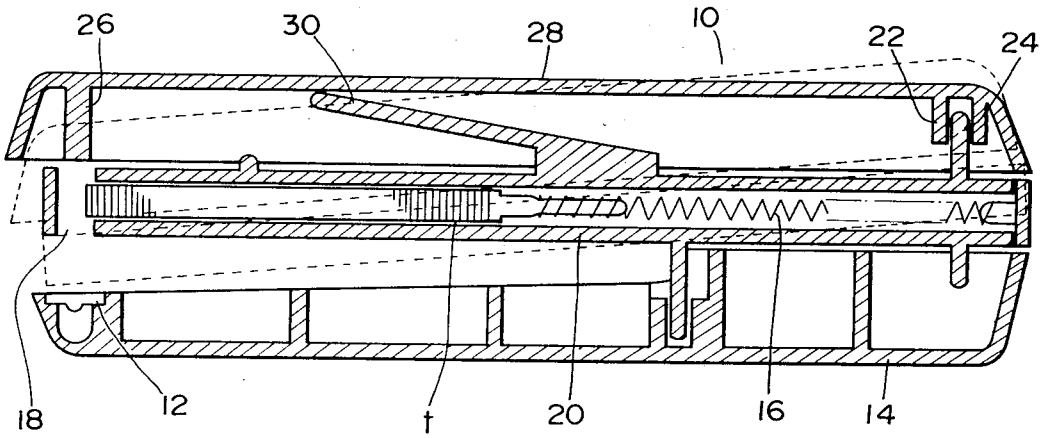
FIG. 2 is a longitudinal section of a stapler including a handle portion which is provided with the actuating member shown in FIGS. 1A and 1B.

Referring first to FIG. 2, there is shown a stapler 10 in which the present invention is embodied. The stapler 10 comprises a base portion 14 having an anvil 12 on its forward end, a frame portion 20 containing a set of staples t and including a coil spring 16 forwardly biasing the staple set to position the forwardmost one of the staples t at a location coincident with a staple driving aperture 18 which is formed in the frame portion 20 at its forward end, and a handle portion 28 pivotally mounted on the frame portion 20 by a boss 22 formed inwardly in the handle portion 28 at its rearward end and a projection 24 formed on the rearward end of the frame portion 20 and fitted into the boss 22 of the handle portion 28. The handle portion 28 includes an actuating member 26 formed thereon at its forward end and extending downwardly therefrom to co-operate with the staple driving aperture 18 of the frame portion 20. The handle portion 28 is resiliently biased away from the frame portion 20 by means of a leaf spring 30 which extends forwardly and upwardly from the top of the frame portion 20. Such a construction of the stapler is similar to those of the conventional staplers made of plastic materials and will not further described with respect to the other parts.

On operation, the base portion 14 is normally carried by an operator and the handle portion 28 is then manually pivoted toward the frame portion 20 against the action of the leaf spring 30. As shown by dotted line in FIG. 2, the actuating member 26 of the handle portion 28 is then moved through the staple driving aperture 18 of the frame portion 20 and drives the forwardmost one of the staple set t in the frame portion 20 downwardly toward the anvil 12 on the base portion 14 to deform that staple thereon.

Figure 1A:
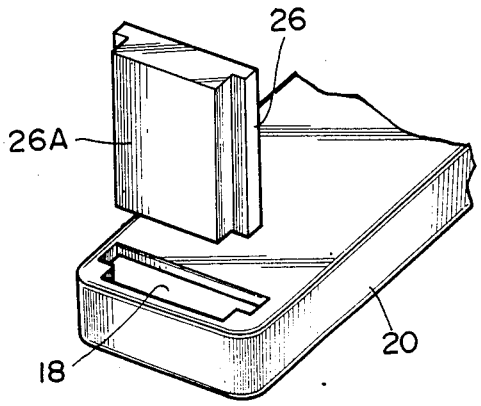
FIG. 1A is a fragmentary and perspective view of a stapler constructed according to the present invention, showing an actuating member.
Figure 1B:
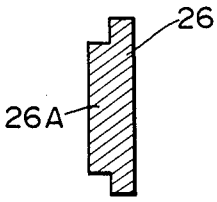
FIG. 1B is a cross-sectional view of the actuating member shown in FIG. 1.

As can be seen from FIG. 2, at least the handle portion 28 may be injection molded integrally with the actuating member 26 from any suitable plastic material. In accordance with the present invention, the actuating member 26 includes a body portion having a plate-shaped cross-section and a thick-walled reinforcing portion 26A in the form of a similar plate-shaped cross-section which has the opposite side edges located inwardly from and parallel to the respective side edges of the body portion of the actuating member 26 and extending along the length of the actuating member 26, as seen from FIG. 1A. The cross-section of the reinforcing portion 26A is clearly shown in FIG. 1B. With such a cross-sectional configuration, the rigidity of the actuating member 26 is increased to improve its durability although it is made of a plastic material.

Plastic materials suitable to be used herein include ABS resins, polyacetal resins, polycarbonate resins, polyimide resins, polysulfone, glass-fiber reinforced nylon and others all of which are called "engineering plastics". Normally, an actuating member of steel may resist use through 30,000 times. Experiments showed that actuating members of ABS and polyacetal resins resisted use through 10,000 and 20,000 times, respectively. Such a durability is commercially sufficient in disposable staplers of plastics which have already been proposed by the inventors.

Experiments showed that if the body of the actuating member had a thickness of 0.5–0.7 millimeters, the desirable results could be obtained when the reinforcing portion has the same thickness as that of the actuating member body. The smaller the distance between one side edge of the actuating member body and the corresponding side edge of the reinforcing portion, the more desirable rigidity of the actuating member is obtained.

It is preferred that the staple driving aperture 18 formed in the frame portion 20 is of a shape coincidence with the cross-sectional configuration of the actuating member 26, as shown in FIG. 2.

Figure 3:
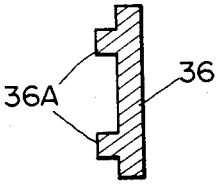
FIG. 3 is a cross-sectional view of a modified actuating member according to the present invention.
Figure 4:
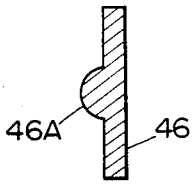
FIG. 4 is a cross-sectional view of another modified actuating member according to the present invention.

The present invention may provide various cross-sectional configurations of the actuating member. For example, FIG. 3 shows an actuating member 36 including two reinforcing ridges 36A which extend along the length of the actuating member. FIG. 4 shows an actuating member 46 having a reinforcing ridge 46A of semi-circular cross-section which extends along the length of the actuating member. It is of course desirable that a staple driving aperture may preferably be formed in each of such actuating members in consistence with its cross-section.

What is claimed is:

1. A throwaway stapler comprising: base means (14) formed with anvil means at its foward end, frame means (20) for containing a set of staples, means for forwardly biasing a set of staples to position the forwardmost one of said staples at a location coincident with a staple driving aperture (18) formed in the forward end of said frame means, longitudinally extending elongated manually engageable handle means (28) pivotally mounted on said frame means opposite said base means, said handle means being made of injection molded plastic, an actuating member (26) disposed at a forward end of said handle means and forming an integral plastic assembly therewith, said member merging laterally downwardly from said handle means, said atuating member being adapted to move through said staple driving aperture in said frame means and to drive the forwardmost staple from said frame means toward said anvil means on said base means when said handle means is pivoted toward said frame means, said plastic actuating member including a body (26, 36, 46) having a plate-shaped cross-section and thick-walled reinforcing means (26A, 36A, 46A) extending along the length of the body of said actuating member to incrase the durability of the stapler.

* * * * *